US011583983B2

(12) United States Patent
Hong

(10) Patent No.: US 11,583,983 B2
(45) Date of Patent: Feb. 21, 2023

(54) ASSEMBLY TOOL FOR CHANGING BUSHINGS FOR LOWER ARM

(71) Applicants: Hyundai Motor Company, Seoul (KR); Kia Motors Corporation, Seoul (KR)

(72) Inventor: Deok-Hee Hong, Ulsan (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/890,589

(22) Filed: Jun. 2, 2020

(65) Prior Publication Data

US 2021/0260738 A1 Aug. 26, 2021

(30) Foreign Application Priority Data

Feb. 20, 2020 (KR) ..... 10-2020-0020840

(51) Int. Cl.
*B25B 27/06* (2006.01)
*B25B 27/00* (2006.01)

(52) U.S. Cl.
CPC ..... *B25B 27/062* (2013.01); *B25B 27/0035* (2013.01)

(58) Field of Classification Search
CPC ..... B25B 27/0028; B25B 27/0035; B25B 27/023; B25B 27/06; B25B 27/062; Y10T 29/53657; Y10T 29/53796; Y10T 29/53848; Y10T 29/53878
See application file for complete search history.

(56) References Cited

U.S. PATENT DOCUMENTS 1,736,529 A * 11/1929 Goeller ..... B25B 27/062 29/263
3,110,958 A * 11/1963 McCord ..... B25B 27/062 29/263
3,123,901 A * 3/1964 Traugott ..... B25B 27/062 29/263
3,862,483 A * 1/1975 Kloster ..... B25B 27/023 29/257
4,207,664 A * 6/1980 Zoula ..... B25B 27/062 D8/51

(Continued)

FOREIGN PATENT DOCUMENTS

KR 10-0175093 2/1999

OTHER PUBLICATIONS https://piedmontfasteners.com/tips/now-do-lock-nuts-work/, How Do Lock Nuts Work?, Sep. 3, 2016 (Year: 2016).*

*Primary Examiner* — Joseph J Hail
*Assistant Examiner* — Jonathan R Zaworski
(74) *Attorney, Agent, or Firm* — Fox Rothschild LLP

(57) ABSTRACT

An assembly tool for changing bushings for a lower arm includes a bushing connecting part into which a bushing is inserted and a main shaft inserted into components. A main adapter assembling unit supports or presses the bushing and a detachment adapter receives the bushing when detaching the bushing. A mounting adapter supports a first end of the bushing when mounting the bushing and a mounting guide ring guides an insertion depth of the bushing when mounting the bushing so that components used to change the bushings may be assembled in accordance with a shape of a lower arm on which the bushing is to be mounted.

8 Claims, 10 Drawing Sheets

(56) References Cited

U.S. PATENT DOCUMENTS

| | | | | | |
|---|---|---|---|---|---|
| 4,259,774 | A * | 4/1981 | Dolinski | B25B 27/023 | 29/263 |
| 4,619,027 | A * | 10/1986 | Ohannesian | B25B 27/0035 | 29/275 |
| 4,724,608 | A * | 2/1988 | Parrott | B25B 27/023 | 29/259 |
| 5,165,169 | A * | 11/1992 | Boyce | B25B 27/062 | 29/898.07 |
| 5,715,600 | A * | 2/1998 | Marriott | F16D 3/382 | 464/130 |
| 6,442,817 | B1 * | 9/2002 | Swanson | B25B 27/06 | 29/275 |
| 7,818,860 | B2 * | 10/2010 | Hume | B25B 27/023 | 29/259 |
| 7,918,003 | B2 * | 4/2011 | Acciardo, Jr. | B25B 27/062 | 29/270 |
| 8,464,428 | B1 * | 6/2013 | Parks | B25B 27/062 | 29/898.07 |
| 9,505,112 | B1 * | 11/2016 | Huang | B25B 27/02 | |
| 9,718,177 | B1 * | 8/2017 | Bell | B25B 25/005 | |
| 2009/0106963 | A1 * | 4/2009 | Acciardo, Jr. | B25B 27/062 | 29/270 |

* cited by examiner

ASSEMBLY TOOL FOR CHANGING BUSHINGS FOR LOWER ARM

CROSS-REFERENCE TO RELATED APPLICATIONS

This application claims priority under 35 U.S.C. § 119 to Korean Patent Application No. 10-2020-0020840, filed on Feb. 20, 2020, the disclosure of which is incorporated herein by reference in its entirety.

BACKGROUND

1. Field of the Invention

The present disclosure relates to an assembly tool for changing bushings for a lower arm, and more particularly, to an assembly tool for changing bushings for a lower arm, the assembly tool being assembled on site, mounted on a lower arm, and used to change bushings.

2. Description of the Related Art

In general, a suspension system for a vehicle is installed to improve ride quality and traveling stability and inhibits or rapidly reduces vibration transmitted from vehicle wheels while stably supporting a vehicle body on the vehicle wheels. The suspension system includes lower arms that connect the vehicle wheels to the vehicle body and support the vehicle body.

As illustrated in FIG. 1, a lower arm 1 has three ends and is structured such that a vehicle body mounting bushing 2 (e.g., an A-bushing), a geometric bushing 3 (e.g., a G-bushing), and a ball joint 4 are integrally combined with the three ends of the lower arm 1, respectively. Further, the vehicle body mounting bushing 2 and the geometric bushing 3 are connected to a vehicle body frame, and the ball joint 4 is connected to the vehicle wheel by being combined with a knuckle of the vehicle wheel.

In particular, the G-bushing is generally manufactured to have hard characteristics since the G-bushing supports most of loads transmitted to the lower arm. However, if a crack is formed in a portion where the G-bushing is provided, noise is caused by unevenness of a road surface, causing inconvenience to a driver.

In such a situation, the entire lower arm is detached and then a new lower arm is mounted. However, since a unit price of the lower arm is high and a substantial period of time is required to change the bushings, an increase in costs occurs when detaching the entire lower arm and mounting a new lower arm. Therefore, to solve the above-mentioned problem, there is a need for a tool capable of being used to change bushings, particularly, G-bushings for a lower arm.

Meanwhile, a developed technique of the related art discloses a tool including a main body, a bushing inserting/detaching member, and a screw shaft inserted into the bushing inserting/detaching member. The bushing inserting/detaching member is moved as the screw shaft rotates, such that a bushing assembled to a lower arm is removed from the lower arm or a bushing is assembled to the lower arm.

However, in this developed technique, the bushing sways while replacing the bushing. In addition, components may be withdrawn due to damage to the screw shaft during the process of replacing the bushing, which may cause a safety problem.

SUMMARY

The present disclosure provides an assembly tool for changing bushings for a lower arm, the assembly tool being capable of being used to stably replace a bushing connected to a lower arm without swaying the bushing and to solve a problem with safety that may be caused during a process of changing the bushings.

An exemplary embodiment of the present disclosure provides an assembly tool for changing bushings for a lower arm that may include: a bushing connecting part formed on a lower arm and having a connecting aperture into which a bushing may be inserted; a main shaft having a threaded portion formed on an outer circumferential surface thereof and configured to be inserted into a center aperture of the bushing; a main adapter assembling unit into which the main shaft may be inserted, the main adapter assembling unit being coupled by thread engagement to the main shaft to be movable in a longitudinal direction of the main shaft and configured to support a first end of the bushing to prevent the bushing from swaying; a first detachment adapter into which the main shaft may be inserted so that the first detachment adapter receives a first end of the main adapter assembling unit, the first detachment adapter being configured to receive the bushing that moves in a direction in which the bushing is detached as the main shaft rotates; and a second detachment adapter into which the main shaft may be inserted, the second detachment adapter being configured to press the bushing to cause the bushing to move in the direction in which the bushing is detached as the main shaft rotates.

Another exemplary embodiment of the present disclosure provides an assembly tool for changing bushings for a lower arm may include: a bushing connecting part formed on a lower arm and having a connecting aperture to which a bushing may be connected; a main shaft having a threaded portion formed on an outer circumferential surface thereof and configured to be inserted into a center aperture of the bushing; a main adapter assembling unit into which the main shaft may be inserted so that the main adapter assembling unit is coupled to the main shaft by thread engagement so that the main adapter assembling unit is movable in a longitudinal direction of the main shaft, the main adapter assembling unit being configured to support or press a first end of the bushing; and a mounting adapter into which the main shaft may be inserted, the mounting adapter being configured to support or press a second end of the bushing to move the bushing in a direction in which the bushing is mounted as the main shaft rotates. In particular, a marking jig having a marking groove may be detachably mounted on the bushing to form a marking on the bushing through the marking groove to be matched with a directional marking formed on the bushing connecting part.

According to the present disclosure, the assembly tool may be assembled on site and used to replace only a bushing when the bushing is broken down, and therefore, it may be possible to reduce excessive costs incurred when replacing the entire lower arm. Additionally, the bushing may be prevented from swaying and the bushing may be stably supported when detaching the bushing from the lower arm. According to the present disclosure, in the case of a burring type or pipe type lower arm, components may be assembled in accordance with the type of lower arm and used to replace the bushing.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION

Figure 1:
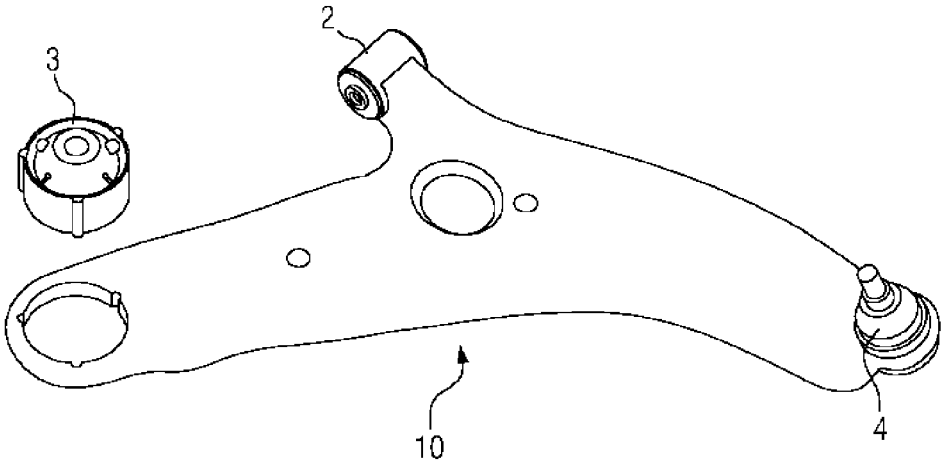
FIG. 1 PRIOR ART
FIG. 1 is a view schematically illustrating a configuration of a lower arm according to the prior art.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, exemplary embodiments of an assembly tool for changing bushings for a lower arm according to the present disclosure will be described in detail with reference to the drawings. Terms or words used herein should not be interpreted as being limited to a general or dictionary meaning and should be interpreted as a meaning and a concept which conform to the technical spirit of the present disclosure based on a principle that an inventor can appropriately define a concept of a term in order to describe his/her own disclosure by the best method.

An assembly tool for changing bushings for a lower arm according to an exemplary embodiment of the present disclosure is a tool that may be assembled on a working site to be used to replace a bushing mounted on a lower arm 10. The assembly tool includes components used to detach a bushing and components used to mount a bushing. In particular, the components used for processes of detaching and mounting the bushings may include the identical components or the components required only for each of the processes of detaching and mounting the bushings. Hereinafter, the description will be made by focusing on the components required for the respective processes of detaching and mounting the bushings, and the description of the identical components will be briefly given or omitted.

Figure 2:
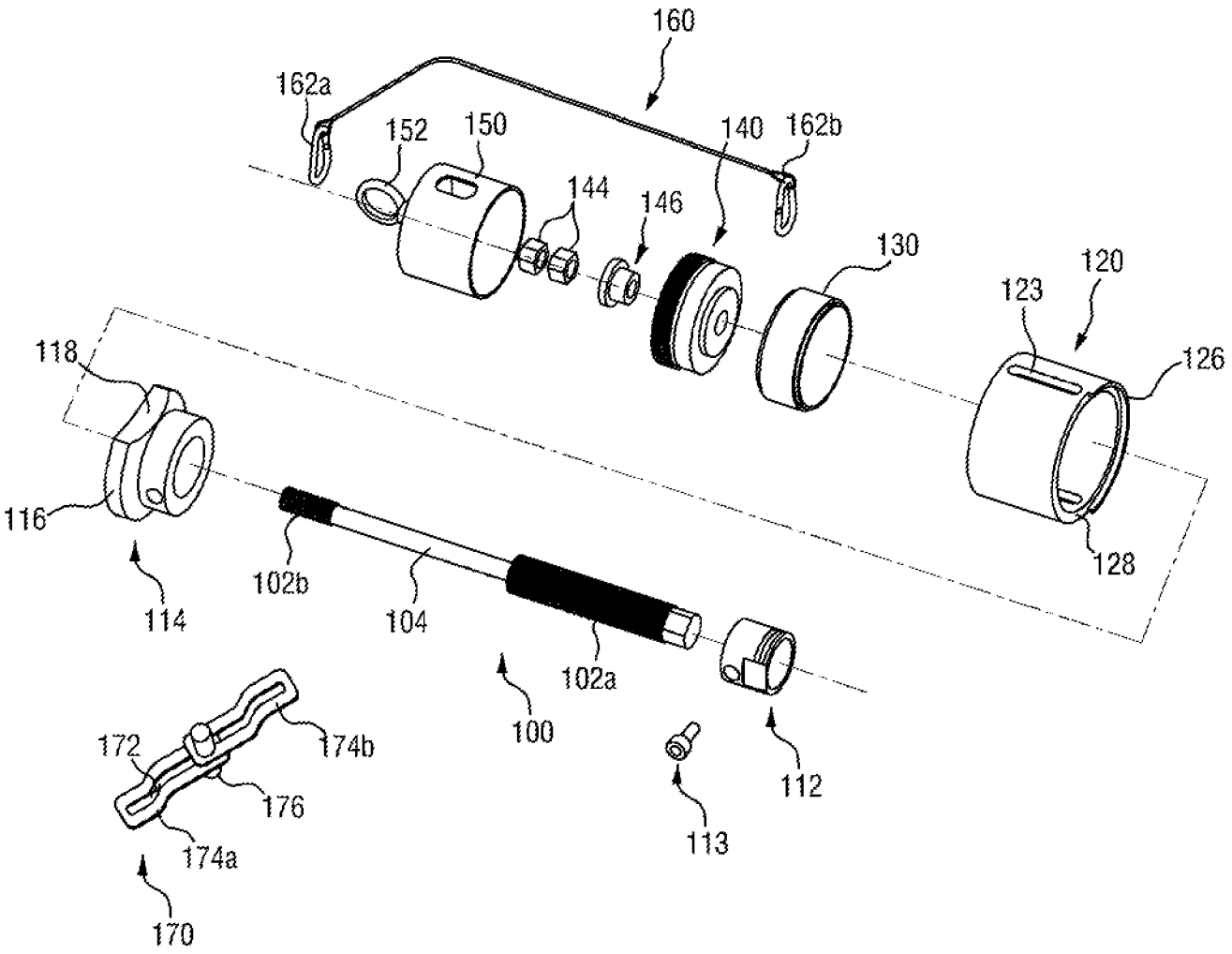
FIG. 2 is a view illustrating a state in which bushing detaching components of an assembly tool for changing bushings for a lower arm according to an exemplary embodiment of the present disclosure are arranged.
Figure 3:
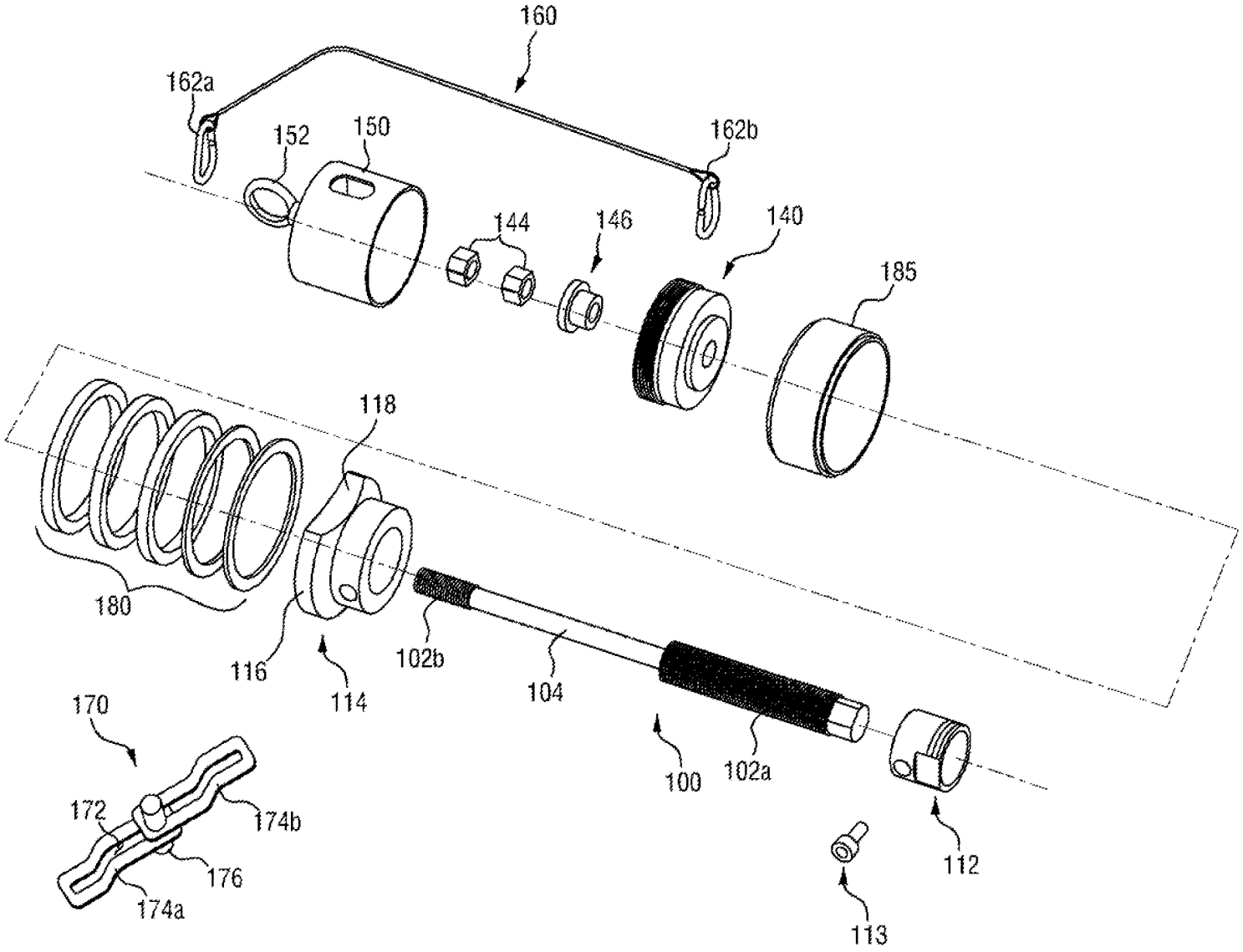
FIG. 3 is a view illustrating a state in which bushing mounting components of the assembly tool for changing bushings for a lower arm according to the exemplary embodiment of the present disclosure are arranged.

FIG. 2 is a view illustrating a state in which bushing detaching components of the assembly tool for changing bushings for a lower arm according to the exemplary embodiment of the present disclosure are arranged, and FIG. 3 is a view illustrating a state in which bushing mounting components of the assembly tool for changing bushings for a lower arm according to the exemplary embodiment of the present disclosure are arranged.

Bushing Detaching Components

As illustrated in FIG. 2, the components used for the process of detaching a bushing may include a main shaft 100, a main adapter assembling unit 110, a first detachment adapter 120, and a second detachment adapter 130, a bearing 140, and anti-loosening nuts 144.

The main shaft 100 may be shaped to be inserted into multiple components and configured to connect the components into which the main shaft 100 is inserted. Additionally, the main shaft 100 may be configured to move the components in an axial direction or restrict the movement of the components. Threaded portions 102*a* and 102*b* having screw threads formed on outer circumferential surfaces thereof may be formed at a first side and a second side of the main shaft 100 according to the exemplary embodiment of the present disclosure, and a non-threaded portion 104 may be formed between the threaded portions 102*a* and 102*b*. A power unit 190 may be connected to the first end of the main shaft 100 to rotate the main shaft 100. The power unit 190 may be a pneumatic device such as an impact wrench or may be human power generated by an operator by means of a wrench tool.

The main adapter assembling unit 110 is formed by assembling a main nut 112 and a main adapter 114. The main nut 112 may include a center aperture into which the main shaft 100 may be inserted, and a screw thread may be formed on an inner circumferential surface of the main nut 112. Therefore, the main shaft 100 may be inserted into the main nut 112, and the main nut 112 may be coupled to the first side threaded portion 102*a* of the main shaft 100 by thread engagement, to thus move the main nut 112 in the axial direction of the main shaft 100.

The main adapter 114 may be configured to receive a part of the main nut 112 and then may be fixed to the main nut 112 as a fastening member 113 is inserted into a aperture formed in the main adapter 114 and a aperture formed in the main nut 112. Therefore, the main adapter assembling unit 110 may be moved in the axial direction of the main shaft 100.

The second side (e.g., opposite to the first side at which the main nut 112 is received) of the main adapter 114 may be configured to support a first end of a bushing 30 or prevent the bushing 30 from swaying and has an approximately circular shape. The outer circumferential surface at the second side of the main adapter 114 according to the exemplary embodiment of the present disclosure may include a first curvature portion 116 having a predetermined curvature and protruding outward, and a second curvature portion 118 having a predetermined curvature and recessed inward.

The first detachment adapter 120 may have a cylindrical shape having a hollow portion to receive the bushing 30. Diameters at both ends of the first detachment adapter 120 may be greater than diameters of connecting apertures 14*a* and 14*b* to be described below. A surface at a first end of the first detachment adapter 120 may be flat, and a surface at a second end (e.g., an opposite end) of the first detachment adapter 120 may include first and second stepped surfaces 126 and 128 that have a level difference therebetween. In particular, when viewed in a longitudinal direction of the first detachment adapter 120, the first stepped surface 126 further protrudes outward than the second stepped surface 128.

According to another exemplary embodiment of the present disclosure, the multiple first detachment adapters 120 may be provided so that one of the multiple first detachment adapters 120 has flat surfaces at both ends thereof and another first detachment adapter 120 has stepped surfaces at both ends thereof. An observation aperture 123 may be formed in an outer circumferential surface of the first detachment adapter 120 so that whether the bushing 30 is detached may be determined. In particular, one or two or more observation apertures 123 may be formed.

The second detachment adapter 120 may include one closed side having a center aperture, and the other opened side (e.g., a first side being closed and a second side being open), and has an approximately cylindrical shape. Diameters at both ends of the second detachment adapter 130 may be less than the diameters of the connecting apertures 14*a* and 14*b* to be described below. The second detachment adapter 130 may be configured to press and detach the bushing 30 inserted into the connecting aperture 14*a* or 14*b*, and the second detachment adapter 130 may have various sizes in accordance with sizes of the bushings 30 to be detached.

The bearing 140 may be a ball bearing in which balls are disposed between an inner race and an outer race. In particular, in bearing 140, the inner race rotates as the main shaft 100 inserted into a hollow portion of the bearing 140 rotates, whereas the outer race does not rotate. A screw thread may be formed on an outer circumferential surface of the bearing 140.

The anti-loosening nut 144 may be coupled and fixed, by thread engagement, to the threaded portion 102*b* at the second side of the main shaft 100. A washer 146 may be inserted between the bearing 140 and the anti-loosening nut 144 to distribute pressure that is applied to the bearing 140 by the anti-loosening nut 144. The single anti-loosening nut 144 may be provided. However, according to the exemplary embodiment of the present disclosure, a pair of anti-loosening nuts 144 may be provided and more securely fastened to the main shaft 100 as the pair of anti-loosening nuts 144 is tightened in opposite directions.

Meanwhile, the assembly tool for changing bushings for a lower arm according to the exemplary embodiment of the present disclosure may further include a safety cap 150 and a safety wire 160 to ensure safety during the process of detaching the bushing. The safety cap 150 may include one closed side (e.g., a first side) having a ring portion 152, and the other opened side (e.g., a second side), and has an approximately cylindrical shape. Diameters at both ends of the safety cap 150 may be less than the diameters of the connecting apertures 14*a* and 14*b* to be described below. The safety cap 150 may prevent the bearing 140 from being withdrawn due to damage to the main shaft 100 when detaching the bushing 30. A screw thread may be formed on an inner circumferential surface of the safety cap 150 and coupled to the screw thread formed on the outer circumferential surface of the bearing 140.

The safety wire 160 may prevent an excessive motion of the assembled components when detaching the bushing 30, and ring connecting portions 162 may be formed at both ends of the safety wire 160 to be caught by the ring portions 152. The ring connecting portion 162 may have various shapes such as a hook or a carabiner that may be caught by the ring portion 152.

Meanwhile, to detach the bushing, the assembly tool for changing bushings for a lower arm according to the exemplary embodiment of the present disclosure may further include a marking jig 170 used to form a directional marking for the bushing 30 to be mounted. The marking jig 170 may include bent portions 174*a* and 174*b* each having a marking groove 172 and a bent shape to be seated on the bushing 30, and a protruding portion 176 formed near a center of the marking jig 170. The marking jig 170 may be attached to or detached from the bushing 30 as the protruding portion 176 is inserted into or withdrawn from a center aperture of the bushing 30. The marking jig 170 assists in forming the directional markings so that the lower arm 10 and the bushing 30 are disposed in a straight line.

Bushing Mounting Components

As illustrated in FIG. 3, the components used for the process of mounting a bushing may include the main shaft 100, the main adapter assembling unit 110, mounting guide rings 180, a mounting adapter 185, the bearing 140, the anti-loosening nuts 144, the safety cap 150, the safety wire 160, and the marking jig 170. In particular, the description of the components identical to the bushing detaching components will be omitted, and only the components different from the bushing detaching components will be described.

The mounting guide rings 180 may be configured to guide an insertion depth when inserting the bushing 30 into the connecting aperture 14*a* to be described below. A diameter of the mounting guide ring 180 may be greater than the diameter of the connecting aperture 14*a*. The mounting guide ring may have various sizes in accordance with sizes of the bushings 30.

The mounting adapter 185 may include one closed side (e.g., a first side) having a center aperture, and the other opened side (e.g., a second side), and has an approximately cylindrical shape. Diameters at both ends of the mounting adapter 185 may be greater than the diameter of the connecting aperture 14*a* to be described below. The mounting adapter 185 may be configured to receive and support or press the bushing 30 mounted in the connecting aperture 14*a*, and the mounting adapter 185 may have various sizes in accordance with sizes of the bushings 30 to be mounted.

Figure 4:
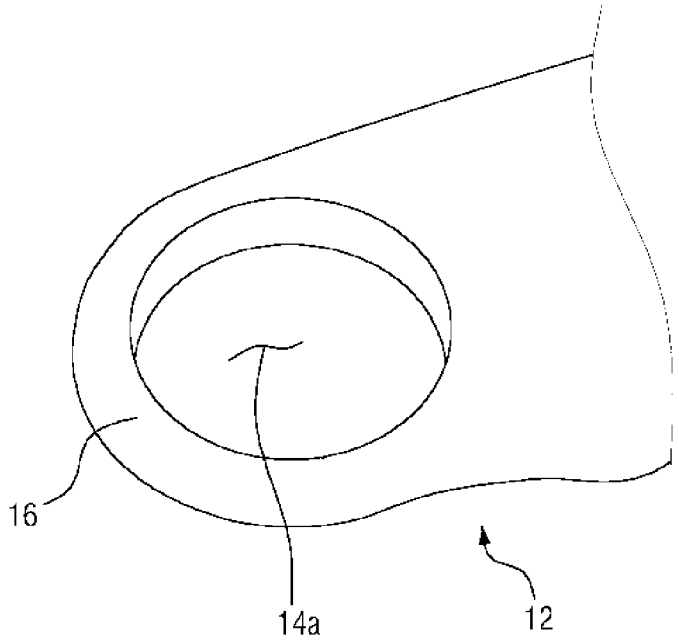
FIG. 4 is a view illustrating a burring type bushing connecting part according to the exemplary embodiment of the present disclosure.
Figure 5:
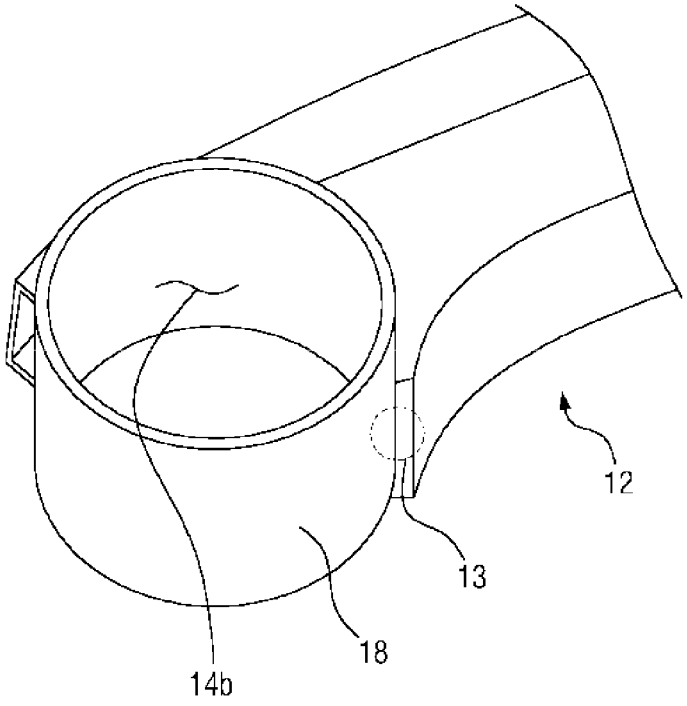
FIG. 5 is a view illustrating a pipe type bushing connecting part according to the exemplary embodiment of the present disclosure.

FIG. 4 is a view illustrating a burring type bushing connecting part according to the exemplary embodiment of the present disclosure, and FIG. 5 is a view illustrating a pipe type bushing connecting part according to the exemplary embodiment of the present disclosure.

Meanwhile, as described above, the assembly tool for changing bushings for a lower arm according to the exemplary embodiment of the present disclosure is provided by being assembled to the lower arm 10. In particular, the lower arm 10 may include a bushing connecting part 12, and the bushing connecting part 12 may have the connecting aperture 14*a* or 14*b* from which the bushing 30 may be detached or into which the bushing 30 may be mounted. The bushing connecting part 12 may be a burring type or pipe type bushing connecting part, and the respective types of bushing connecting parts 12 will be described below.

Referring to FIG. 4, the burring type bushing connecting part 12 has a flat circumferential surface 16 that surrounds the connecting aperture 14*a*. In particular, the component to be assembled to the circumferential surface 16 of the bushing connecting part 12 may have a flat surface to avoid interference with the bushing connecting part 12. For example, the bushing detaching components may be assembled with one surface of the first detachment adapter 120 in contact with the circumferential surface 16.

Referring to FIG. 5, a protruding pipe 18 including the connecting aperture 14*b* may be connected to the pipe type bushing connecting part 12. In particular, a stepped portion 13 may be formed between the pipe 18 and the bushing connecting part 12. Therefore, the component to be assembled to the pipe 18 may have a stepped surface to avoid interference with the bushing connecting part 12. For example, when the bushing detaching components, the first stepped surface 126 at the second end of the first detachment adapter 120 may be positioned on an outer circumferential surface of the pipe 18, and the second stepped surface 128 at the second end of the first detachment adapter 120 may be positioned on the bushing connecting part 12.

According to the assembly tool for changing bushings for a lower arm according to the exemplary embodiment of the present disclosure configured as described above, the process of detaching the bushing and the process of mounting the bushing vary depending on the type of bushing connecting part 12. Hereinafter, the operating processes of the assembly tool for changing bushings for a lower arm, which is assembled in accordance with the type of bushing connecting part 12, will be described.

Process of Detaching Bushing Mounted on Burring Type Bushing Connecting Part

Figure 6:
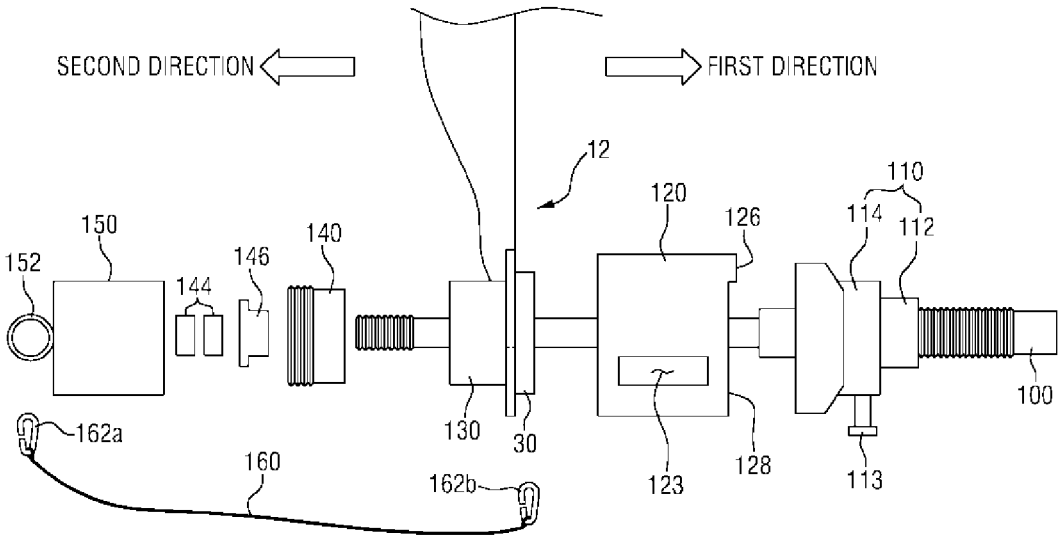
FIG. 6 is a view illustrating a state in which the bushing detaching components of the assembly tool for changing bushings for a lower arm according to the exemplary embodiment of the present disclosure are assembled to the burring type bushing connecting part.
Figure 7:
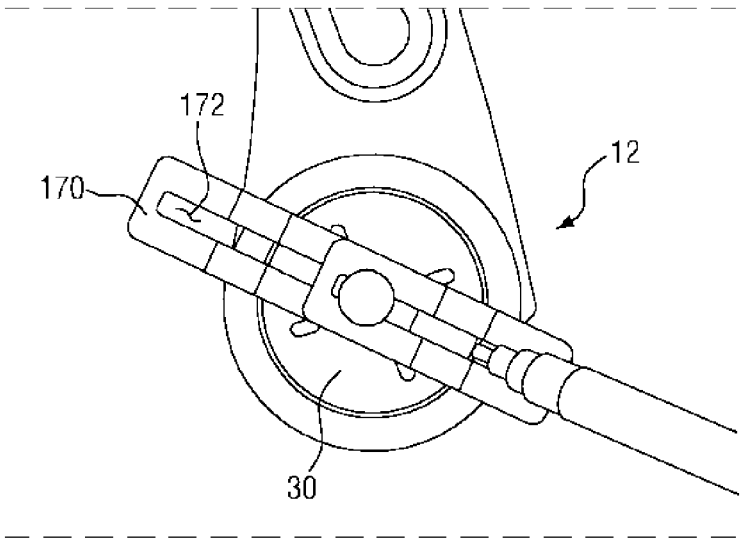
FIG. 7 is a view illustrating a state in which a marking jig is temporarily mounted on a bushing to form a marking when detaching a bushing from the burring type bushing connecting part.
Figure 8:
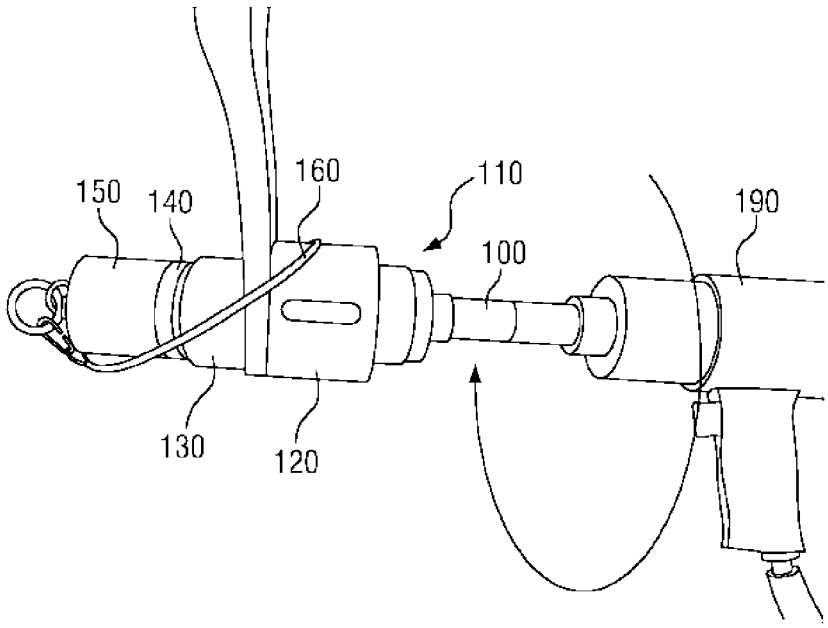
FIG. 8 is a view illustrating a state in which a bushing mounted on the burring type bushing connecting part is detached by the assembly tool for changing bushings for a lower arm according to the exemplary embodiment of the present disclosure.

FIG. 6 is a view illustrating a state in which the bushing detaching components of the assembly tool for changing bushings for a lower arm according to the exemplary embodiment of the present disclosure are assembled to the burring type bushing connecting part, FIG. 7 is a view illustrating a state in which a marking jig is temporarily mounted on a bushing to form a marking when detaching a bushing from the burring type bushing connecting part, and FIG. 8 is a view illustrating a state in which a bushing mounted on the burring type bushing connecting part is detached by the assembly tool for changing bushings for a lower arm according to the exemplary embodiment of the present disclosure.

As illustrated in FIG. 6, a first direction and a second direction may be defined based on the bushing connecting part 12. The main adapter assembling unit 110, the first detachment adapter 120, and the bushing 30 may be positioned in the first direction, and the second detachment adapter 130, the bearing 140, the washer 146, the anti-loosening nuts 144, and the safety cap 150 may be positioned in the second direction.

First, a process of assembling the bushing detaching components to the burring type bushing connecting part will be described. Referring to FIGS. 6 and 7, the bushing 30 to be replaced may be mounted in the connecting aperture 14*a* of the bushing connecting part 12. In particular, to arrange the bushing 30 and the lower arm 10 in a straight line, a direction of the replaced bushing (not illustrated) is matched with a direction of the currently mounted bushing 30.

The protruding portion 176 of the marking jig 170 may be inserted into the center aperture of the bushing 30, and the bent portions 174*a* and 174*b* may be seated in directions toward both sides of the bushing 30 to temporarily mount the marking jig 170 on the bushing 30. When the marking jig 170 is mounted, the directional marking may be formed on the circumferential surface 16 of the bushing connecting part 12 through the marking grooves 172. Next, the first detachment adapter 120 may be positioned to be in contact with the bushing connecting part 12 and thus, the bushing connecting part 12 may be configured to receive one side of the bushing 30. In particular, the flat surface, which is one of the surfaces at both ends of the first detachment adapter 120, may be positioned to be in contact with the circumferential surface 16 of the bushing connecting part 12.

Next, the main adapter assembling unit 110 may be coupled to the threaded portion 102*a* at the first side of the main shaft 100 by thread engagement. In this state, the main shaft 100 may be inserted into the center aperture of the bushing 30. Particularly, the second side (e.g., the side directed toward the first detachment adapter 120) of the main adapter assembling unit 110 may be received in the first detachment adapter 120. Next, the main shaft 100 may be inserted into the second detachment adapter 130 so that the second detachment adapter 130 faces the second surface (e.g., the surface opposite to the circumferential surface 16) of the bushing connecting part 12. A first side (e.g., the side directed toward the bushing connecting part 12) of the second detachment adapter 130 may be configured to receive the bushing 30.

The main shaft 100 may then be inserted into the bearing 140. In particular, the main shaft 100 may be inserted into the washer 146 to protect the bearing 140 and then the main shaft 100 may be inserted into the anti-loosening nuts 144. The components into which the main shaft 100 is inserted move along the main shaft 100 and the movement of the components is restricted when the components are caught by the anti-loosening nuts 144. The safety cap 150 may be coupled to the screw thread formed on the outer circumferential surface of the bearing 140. In this case, when the ring connecting portion 162*a* formed at a first end of the safety wire 160 is connected to the ring portion 152, the safety wire 160 surrounds the bushing connecting part 12, and then the ring connecting portion 162*b* formed at a second end of the safety wire 160 may be connected to the ring portion 152.

Hereinafter, the process of detaching the bushing 30 mounted on the burring type bushing connecting part 12 will be described. Referring to FIG. 8, when the power unit 190 is connected to the first end of the main shaft 100 and then rotates in one direction in the above-mentioned assembled state, the components into which the main shaft 100 is inserted may move in the first direction as the anti-loosening nuts 144 move. In particular, the bearing 140 and the second detachment adapter 130 press the second side of the bushing 30. Since the bushing 30 may be supported by the main adapter assembling unit 110 when the bushing 30 is received in the first detachment adapter 120, the bushing 30 may be prevented from swaying. Since the bushing 30 still moves in the first direction, the bushing 30 may in turn be detached from the connecting aperture 14*a*.

Meanwhile, since the safety wire 160 is connected while surrounding the bushing connecting part 12, the excessive movement of the main shaft 100 in the first direction may be restricted. Thereafter, the power unit 190 may be removed from the main shaft 100, and the ring connecting portions 162*a* and 162*b* of the safety wire 160 may be disconnected from the ring portion 152. Further, the assembled components may be disassembled by performing the process reverse to the above-mentioned process.

Process of Mounting Bushing on Burring Type Bushing Connecting Part

Figure 9:
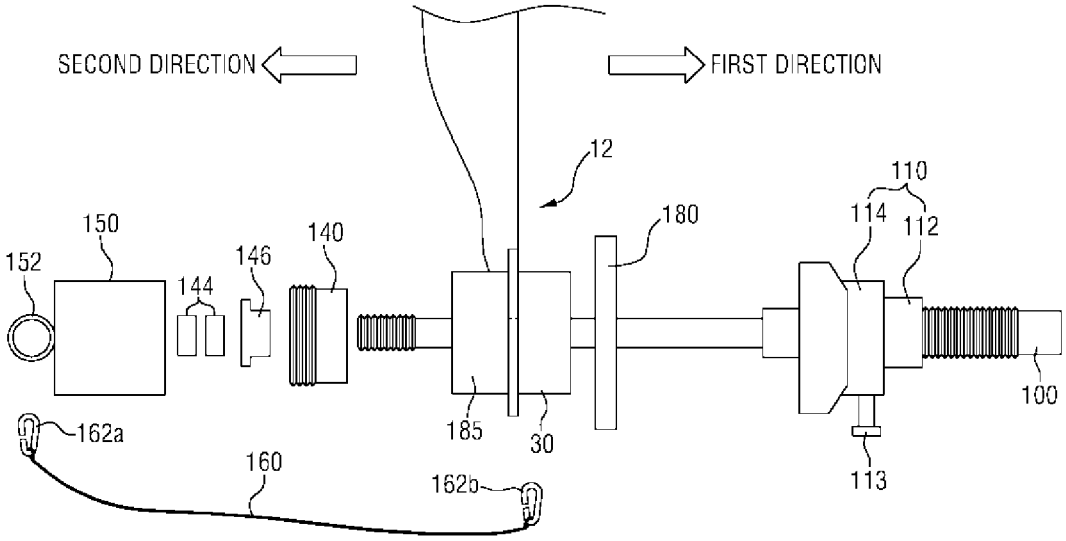
FIG. 9 is a view illustrating a state in which the bushing mounting components of the assembly tool for changing bushings for a lower arm according to the exemplary embodiment of the present disclosure are assembled to the burring type bushing connecting part.
Figure 10:
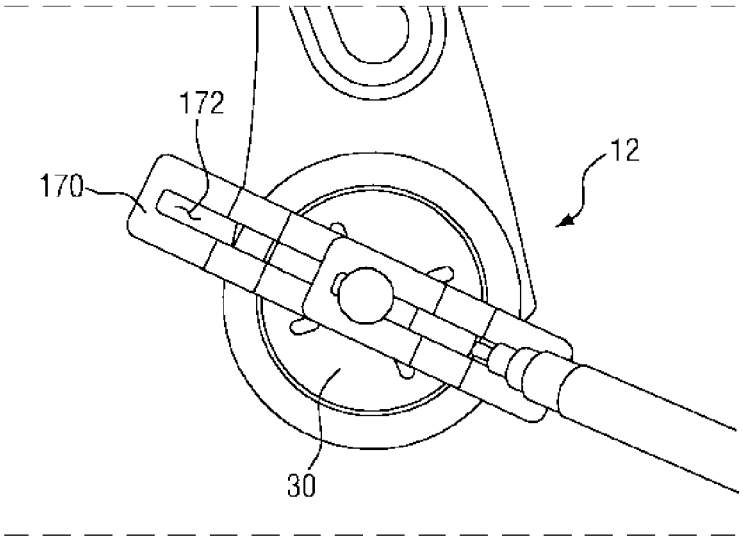
FIG. 10 is a view illustrating a state in which the marking jig is temporarily mounted on a bushing to form a marking when mounting the bushing on the burring type bushing connecting part according to the exemplary embodiment of the present disclosure.
Figure 11:
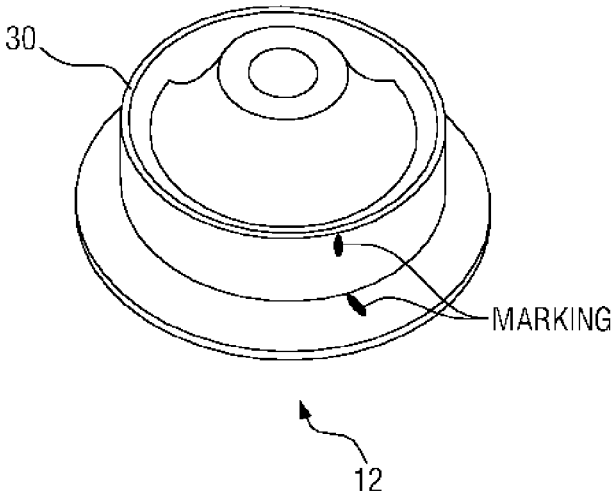
FIG. 11 is a view illustrating a state in which directional markings are formed on a bushing by the marking jig illustrated in FIG. 10 according to the exemplary embodiment of the present disclosure.
Figure 12:
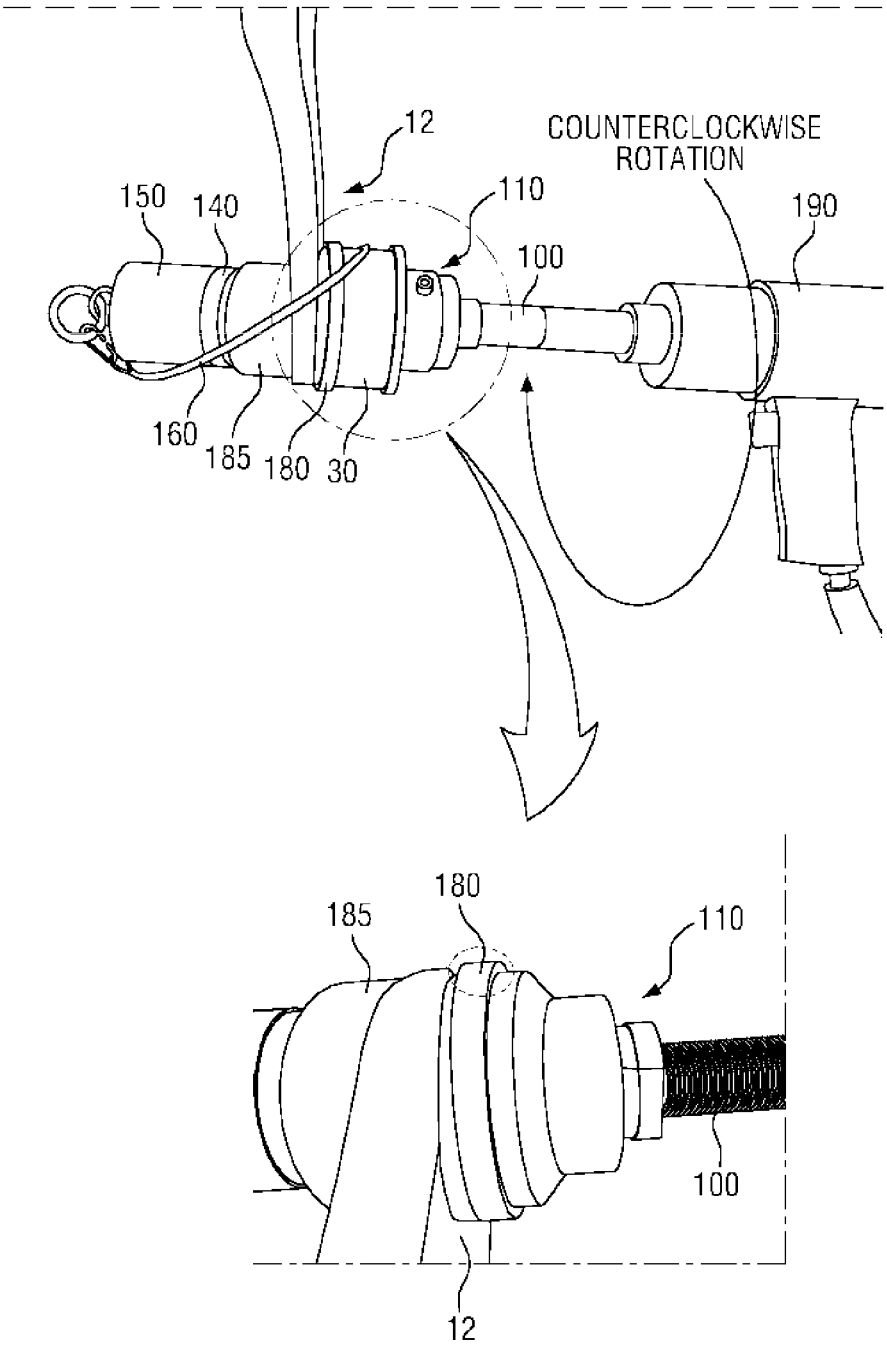
FIG. 12 is a view illustrating a state in which a bushing is mounted on the burring type bushing connecting part by the assembly tool for changing bushings for a lower arm according to the exemplary embodiment of the present disclosure.

FIG. 9 is a view illustrating a state in which the bushing mounting components of the assembly tool for changing bushings for a lower arm according to the exemplary embodiment of the present disclosure are assembled to the burring type bushing connecting part, FIG. 10 is a view illustrating a state in which the marking jig is temporarily mounted on a bushing to form a marking when mounting the bushing on the burring type bushing connecting part, FIG. 11 is a view illustrating a state in which directional markings are formed on a bushing by the marking jig illustrated in FIG. 10, and FIG. 12 is a view illustrating a state in which a bushing is mounted on the burring type bushing connecting part by the assembly tool for changing bushings for a lower arm according to the exemplary embodiment of the present disclosure.

As illustrated in FIG. 9, based on the bushing connecting part 12, the main adapter assembling unit 110, the mounting guide ring 180, and the bushing 30 may be positioned in the first direction, and the mounting adapter 185, the bearing 140, the washer 146, the anti-loosening nuts 144, and the safety cap 150 may be positioned in the second direction. First, a process of assembling the bushing mounting components to the burring type bushing connecting part will be described.

Referring to FIGS. 9 to 11, a bushing (not illustrated) to be changed may be separated from the connecting aperture 14*a* of the bushing connecting part 12. When the bushing 30 is disposed on the connecting aperture 14*a*, the marking jig 170 may be temporarily mounted to be matched with the directional marking which has been formed on the circumferential surface 16 of the bushing connecting part 12 during the process of detaching a bushing (not illustrated). In particular, a directional marking may be formed on the bushing 30 through the marking grooves 172 to be matched with the directional marking formed on the circumferential surface 16 of the bushing connecting part 12.

Next, the mounting guide ring 180 may be coupled to the bushing connecting part 12 to surround the bushing 30. The main shaft 100 to which the main adapter assembling unit 110 is coupled by thread engagement may then be inserted into the center aperture of the bushing 30. The main shaft 100 may be inserted into the mounting adapter 185 so that the mounting adapter 185 faces the second surface (e.g., the surface opposite to the circumferential surface 16) of the bushing connecting part 12.

Hereinafter, the process of assembling the components is identical to the above-mentioned process of assembling the bushing detaching components. Hereinafter, the process of mounting the bushing 30 on the burring type bushing connecting part 12 will be described.

Referring to FIG. 12, when the power unit 190 is connected to the first end of the main shaft 100 and rotates in one direction in the above-mentioned assembled state, the main adapter assembling unit 110 may be configured to press the first side of the bushing 30 in the second direction to insert the bushing 30 into the connecting aperture 14*a*. In particular, when the main adapter assembling unit 110 comes into contact with the mounting guide ring 180, the bushing 30 is not inserted any further. Meanwhile, the mounting adapter 185 may be configured to receive the second side of the bushing 30 while being supported by the bushing connecting part 12. Thereafter, when the bushing 30 is completely mounted, the power unit 190 may be configured to rotate in the other direction to unfasten the components. The process of separating the assembled components is identical to the above-mentioned process of separating the bushing detaching components.

Process of Detaching Bushing Mounted on Pipe Type Bushing Connecting Part

Figure 13:
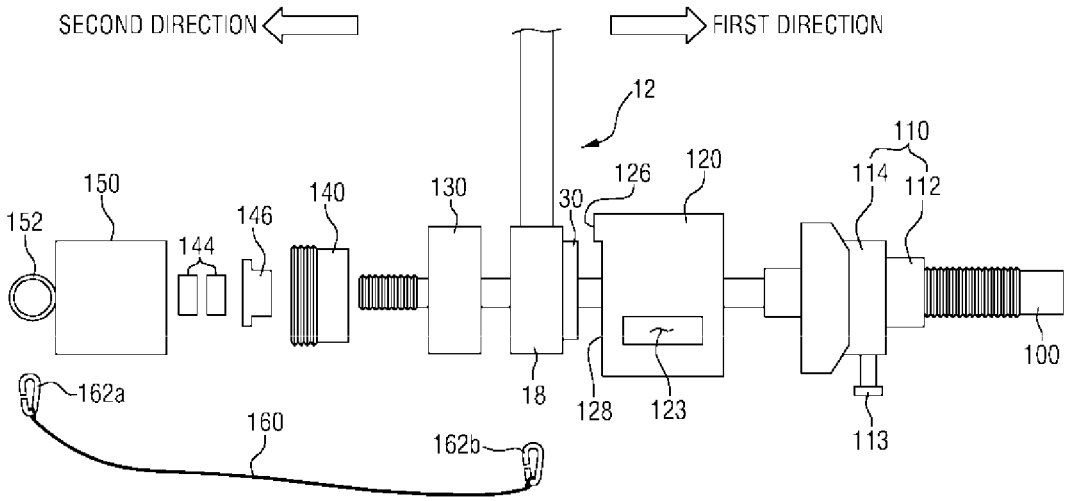
FIG. 13 is a view illustrating a state in which the bushing detaching components of the assembly tool for changing bushings for a lower arm according to the exemplary embodiment of the present disclosure are assembled to the pipe type bushing connecting part.
Figure 14:
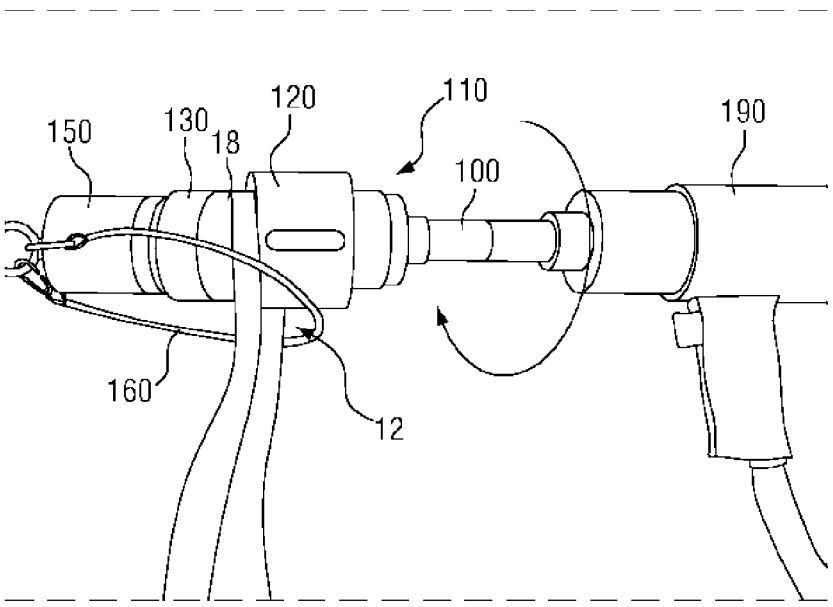
FIG. 14 is a view illustrating a state in which a bushing mounted on the pipe type bushing connecting part is detached by the assembly tool for changing bushings for a lower arm according to the exemplary embodiment of the present disclosure.

FIG. 13 is a view illustrating a state in which the bushing detaching components of the assembly tool for changing bushings for a lower arm according to the exemplary embodiment of the present disclosure are assembled to the pipe type bushing connecting part, and FIG. 14 is a view illustrating a state in which a bushing mounted on the pipe type bushing connecting part is detached by the assembly tool for changing bushings for a lower arm according to the exemplary embodiment of the present disclosure.

The process of assembling the bushing detaching components on the pipe type bushing connecting part is identical to the process of assembling bushing detaching components on the burring type bushing connecting part 12 except for a direction in which the first detachment adapter 120 is assembled. Therefore, the description will be made by focusing on the direction in which the first detachment adapter 120 is assembled.

The bushing 30 to be replaced may be mounted in the connecting aperture 14*b* of the pipe 18 of the bushing connecting part 12. The first detachment adapter 120 may be positioned to be in contact with the bushing connecting part 12 to receive the pipe 18 of the bushing connecting part 12. In particular, the stepped surface at the second end of the first detachment adapter 120 may be positioned to be in contact with one surface of the bushing connecting part 12.

Specifically, referring to back to FIG. 5, the stepped portion 13 may be formed between the pipe 18 and the bushing connecting part 12. Therefore, to avoid the interference between the bushing connecting part 12 and the first detachment adapter 120, the first stepped surface 126 of the first detachment adapter 120 may be positioned to surround the pipe 18, and the second stepped surface 128 of the first detachment adapter 120 may be positioned to be in contact with one surface of the bushing connecting part 12.

Hereinafter, the process of detaching the bushing 30 mounted on the pipe type bushing connecting part 12 is identical to the process of detaching the bushing 30 mounted on the burring type bushing connecting part.

Process of Mounting Bushing on Pipe Type Bushing Connecting Part

Figure 15:
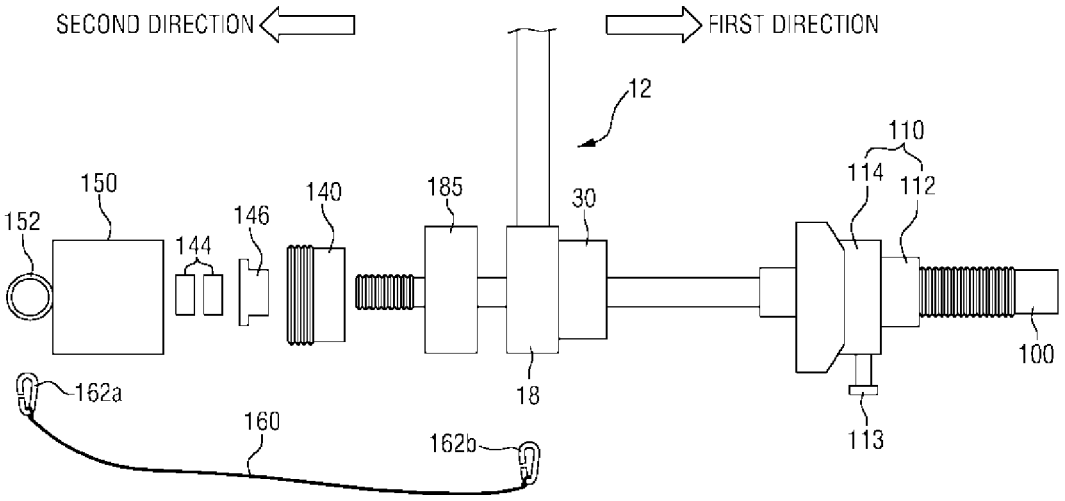
FIG. 15 is a view illustrating a state in which the bushing mounting components of the assembly tool for changing bushings for a lower arm according to the exemplary embodiment of the present disclosure are assembled to the pipe type bushing connecting part.
Figure 16:
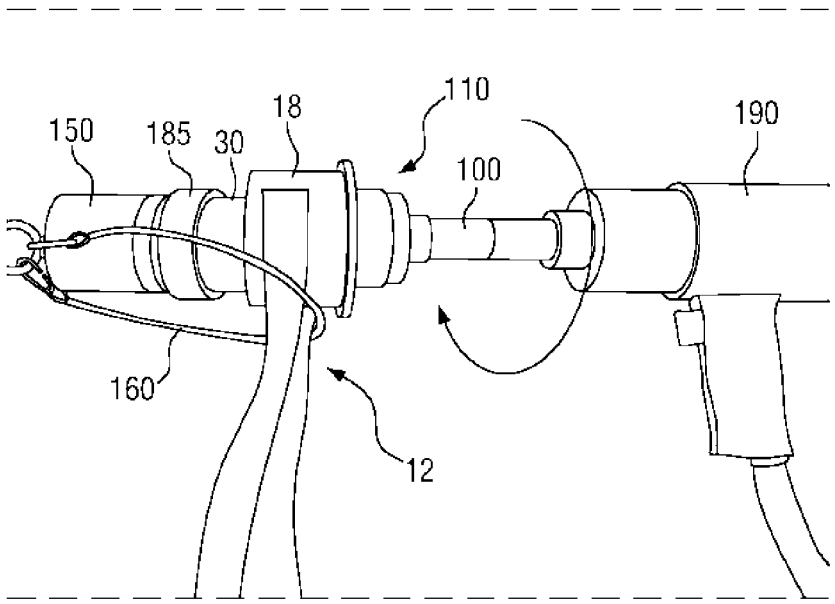
FIG. 16 is a view illustrating a state in which a bushing is mounted on the pipe type bushing connecting part by the assembly tool for changing bushings for a lower arm according to the exemplary embodiment of the present disclosure.

FIG. 15 is a view illustrating a state in which the bushing mounting components of the assembly tool for changing bushings for a lower arm according to the exemplary embodiment of the present disclosure are assembled to the pipe type bushing connecting part, and FIG. 16 is a view illustrating a state in which a bushing is mounted on the pipe type bushing connecting part by the assembly tool for changing bushings for a lower arm according to the exemplary embodiment of the present disclosure.

The process of assembling the bushing mounting components to the pipe type bushing connecting part 12 is identical to the process of assembling the bushing mounting components to the burring type bushing connecting part except for a process of assembling the mounting guide rings 180. Further, the process of mounting the bushing 30 on the pipe type bushing connecting part 12 is identical to the process of mounting the bushing 30 on the burring type bushing connecting part.

The reason why the mounting guide ring 180 is not used during the process of mounting the bushing 30 on the pipe type bushing connecting part 12 is as follows. The bushing 30 exposed to the outside of the pipe 18 may be inserted into the connecting aperture 14*b* by being pressed by the main adapter assembling unit 110, but is not inserted any further at a position at which the bushing is not exposed to the outside of the pipe 18. In other words, when the pipe type bushing connecting part 12, it is not necessary to guide a depth of the bushing 30 to be inserted into the pipe 18.

The present disclosure has been described with reference to the limited exemplary embodiments and the drawings, but the present disclosure is not limited thereto. The described exemplary embodiments may be variously changed or modified by those skilled in the art to which the present disclosure pertains within the technical spirit of the present disclosure and within the scope equivalent to the appended claims.

What is claimed is:

1. An assembly tool for changing a bushing for a lower arm in which the lower arm comprises a bushing connecting part having a connecting aperture, the assembly tool comprising:

a main shaft having a threaded portion formed on an outer circumferential surface thereof and configured to be inserted into a center aperture of the bushing;

a main adapter assembling unit into which the main shaft is inserted, the main adapter assembling unit being coupled by thread engagement to the main shaft to be movable in a longitudinal direction of the main shaft and configured to support a first end of the bushing to prevent the bushing from swaying;

a first detachment adapter into which the main shaft is inserted so that the first detachment adapter receives a first end of the main adapter assembling unit, the first detachment adapter being configured to receive the bushing that moves in a direction in which the bushing is detached as the main shaft rotates;

a second detachment adapter into which the main shaft is inserted, the second detachment adapter being configured to press the bushing to move the bushing in the direction in which the bushing is detached as the main shaft rotates; and a bearing configured to press the second detachment adapter as the main shaft rotates, wherein a screw thread is formed on an outer circumferential surface of the bearing, and the assembly tool further includes a safety cap having a screw thread formed on an inner surface thereof to be coupled to the bearing by thread engagement and configured to prevent the bearing from being withdrawn.

2. The assembly tool of claim 1, wherein the main adapter assembling unit includes:

a main nut having a screw thread formed on an inner circumferential surface thereof to be coupled to the main shaft by thread engagement; and a main adapter having a first side connected to the main nut, and a second side inserted into and connected to the first detachment adapter.

3. The assembly tool of claim 1, wherein a surface at a first end of the first detachment adapter is flat, and a surface at a second end of the first detachment adapter has multiple stepped surfaces having level differences therebetween.

4. The assembly tool of claim 3, wherein one surface of the first detachment adapter is assembled to be in contact with a flat circumferential surface of the bushing connecting part having the connecting aperture.

5. The assembly tool of claim 3, wherein a surface at the second end of the first detachment adapter includes multiple stepped surfaces having level differences therebetween, and any one of the multiple stepped surfaces is assembled to be in contact with the bushing connecting part to avoid interference with the bushing connecting part.

6. The assembly tool of claim 1, wherein a diameter of the second detachment adapter is less than a diameter of the connecting aperture.

7. The assembly tool of claim 1, further comprising an anti-loosening nut fixedly fastened to the main shaft.

8. The assembly tool of claim 1, further comprising: a safety wire, wherein the safety wire surrounds the lower arm and both ends of the safety wire are connected to the safety cap.

* * * * *